US012788072B2

(12) United States Patent
Parry et al.

(10) Patent No.: US 12,788,072 B2
(45) Date of Patent: Nov. 10, 2026

(54) METHOD FOR CONTROLLING A HEATING SYSTEM FOR AN AEROSOL GENERATION ASSEMBLY AND ASSOCIATED AEROSOL GENERATION ASSEMBLY

(71) Applicant: JT International SA, Geneva (CH)

(72) Inventors: John Parry, Watford (GB); Daniel Vanko, Krpelany (SK); Branislav Zigmund, Vrbovce (SK)

(73) Assignee: JT International SA, Geneva (CH)

( * ) Notice: Subject to any disclaimer, the term of this patent is extended or adjusted under 35 U.S.C. 154(b) by 429 days.

(21) Appl. No.: 18/275,335

(22) PCT Filed: Feb. 4, 2022

(86) PCT No.: PCT/EP2022/052697
§ 371 (c)(1),
(2) Date: Aug. 1, 2023

(87) PCT Pub. No.: WO2022/167575
PCT Pub. Date: Aug. 11, 2022

(65) Prior Publication Data

US 2024/0099391 A1 Mar. 28, 2024

(30) Foreign Application Priority Data

Feb. 5, 2021 (EP) ..... 21155451

(51) Int. Cl.
*A24F 40/57* (2020.01)
*A24F 40/465* (2020.01)
(Continued)

(52) U.S. Cl.
CPC ..... *A24F 40/57* (2020.01); *A24F 40/465* (2020.01); *A24F 40/42* (2020.01); *A24F 40/51* (2020.01); *A24F 40/53* (2020.01)

(58) Field of Classification Search
CPC ..... A24F 40/53; A24F 40/57; A24F 40/465; A24F 40/20; A24F 40/42; A24F 40/51
See application file for complete search history.

(56) References Cited

U.S. PATENT DOCUMENTS

2020/0245686 A1* 8/2020 Gill ..... G05B 19/042
2020/0367569 A1 11/2020 Farine
(Continued)

FOREIGN PATENT DOCUMENTS

CN 108652089 A 10/2018
CN 111356378 A 6/2020
(Continued)

OTHER PUBLICATIONS

International Search Report for Application No. PCT/EP2022/052697 mailed Apr. 19, 2022, pp. 1-4.
(Continued)

*Primary Examiner* — Elizabeth L Mckane
(74) *Attorney, Agent, or Firm* — Lerner David LLP

(57) ABSTRACT

The present invention concerns a method for controlling a heating system for an aerosol generation assembly containing a vaporizable material. The method includes controlling the temperature of a susceptor, during a pre heating phase, based on at least one vaporizable material characteristic inherent to the vaporizable material, at least one device characteristic inherent to the aerosol generation assembly, or on an ambient characteristic inherent to the ambient area; and controlling the temperature of the susceptor, during a heating phase, based on temperature measurements provided by a heating temperature sensor and a predetermined offset.

17 Claims, 4 Drawing Sheets

(51) Int. Cl.

| | |
|---|---|
| ***A24F 40/51*** | (2020.01) |
| *A24F 40/42* | (2020.01) |
| *A24F 40/53* | (2020.01) |

(56) References Cited

U.S. PATENT DOCUMENTS

| | | | |
|---|---|---|---|
| 2021/0000185 | A1 | 1/2021 | Jung et al. |
| 2021/0029786 | A1 | 1/2021 | Lee |
| 2021/0052829 | A1 | 2/2021 | Dignum et al. |
| 2021/0059309 | A1 | 3/2021 | Gill |
| 2021/0112870 | A1 | 4/2021 | Park et al. |
| 2021/0298364 | A1 | 9/2021 | Yu et al. |

FOREIGN PATENT DOCUMENTS

| | | | | | |
|---|---|---|---|---|---|
| CN | 111432669 | A | | 7/2020 | |
| CN | 111542239 | A | | 8/2020 | |
| CN | 111698917 | A | | 9/2020 | |
| CN | 112055548 | A | | 12/2020 | |
| CN | 112841755 | A | | 5/2021 | |
| KR | 20190051785 | A | | 5/2019 | |
| KR | 20200108891 | A | | 9/2020 | |
| KR | 20210000980 | A | | 1/2021 | |
| TW | I608805 | B | * | 12/2017 | ..... H05B 1/0225 |
| WO | WO-2019129637 | A1 | * | 7/2019 | ..... H05B 6/108 |
| WO | WO-2019129845 | A1 | * | 7/2019 | ..... A61M 15/06 |
| WO | 2020008008 | A1 | | 1/2020 | |
| WO | 2020029923 | A1 | | 2/2020 | |
| WO | 2020064686 | A1 | | 4/2020 | |
| WO | 2020122409 | A1 | | 6/2020 | |
| WO | 2020141718 | A1 | | 7/2020 | |
| WO | 2020182772 | A1 | | 9/2020 | |
| WO | 2021105463 | A1 | | 6/2021 | |

OTHER PUBLICATIONS

Search Report dated Dec. 5, 2025 from the Office Action for Chinese Application No. 202280013021.X issued Dec. 8, 2025, pp. 1-3.

* cited by examiner

METHOD FOR CONTROLLING A HEATING SYSTEM FOR AN AEROSOL GENERATION ASSEMBLY AND ASSOCIATED AEROSOL GENERATION ASSEMBLY

CROSS-REFERENCE TO RELATED APPLICATIONS

The present application is a national phase entry under 35 U.S.C. § 371 of International Application No. PCT/EP2022/052697, filed Feb. 4, 2022, published in English, which claims priority to European Application No. 21155451.4, filed Feb. 5, 2021, the disclosures of which are incorporated herein by reference.

FIELD OF THE INVENTION

The present invention concerns a method for controlling a heating system for an aerosol generation assembly.

The present invention also concerns an aerosol generation assembly associated to such a method for controlling a heating system. The aerosol generation assembly may for example comprise an aerosol generation device and a cartridge.

BACKGROUND OF THE INVENTION

Different types of aerosol generation devices are already known in the art. Generally, such devices comprise a storage portion for storing a vaporizable material, which can comprise for example a liquid or a solid. A heating system is formed of one or more electrically activated resistive heating elements arranged to heat said vaporizable material to generate the aerosol. The aerosol is released into a flow path extending between an inlet and outlet of the device. The outlet may be arranged as a mouthpiece, through which a user inhales for delivery of the aerosol.

In some aerosol generation devices, the vaporizable material is stored in a removable cartridge. Thus, when the vaporizable material is consumed, the cartridge can be easily removed and replaced. In order to attach the removable cartridge to the device body, a screw-threaded connection can for example be used.

Different types of heating systems can be used to heat the vaporizable material in such devices. For example, in case of a liquid vaporizable material, a heating system may be formed by a resistance arranged in the flow path and wound around a wick in communication with the liquid vaporizable material. Thus, carried by the wick, the vaporizable material can be evaporated by the resistance arranged in the flow path. According to another example, a heating system comprises a heating plate in direct contact with the vaporizable material which can be for example a solid vaporizable material. Thus, the plate can heat the vaporizable material to form vapour.

According to another example of a heating system, the vaporizable material can be heated by a susceptor element arranged in contact with the vaporizable material. This susceptor element is magnetically coupled with a coil connected to the battery of the device and thus, is able to heat the vaporizable material by induction heating. The source of the generated heat are magnetic hysteresis loss and/or eddy-current loss mechanisms. In this case, the coil is connected to the battery through a self-oscillating circuit making it possible to generate an alternative current on the coil. A controller is usually provided to control this current and as a consequence, the temperature of the vaporizable material.

This last type of heating systems is generally used with solid vaporisable materials and the aerosol generation device integrating such a system is known as "heat not burn" device. Indeed, these heating systems should be able to heat the vaporizable material without burning it. Additionally, in order to provide a better user experience, the vaporizable material can be heated according to a predefined heating profile.

One can thus conceive that an accurate temperature control is crucial for an aerosol generation device. In the art, some heating systems integrating a self-oscillating circuit are not able to provide such a control. The vaporizable material can for example be heated too slowly or on the contrary, too fast. This can burn the vaporizable material and/or provide a poor user experience. Other heating systems may represent a complex structure that increases the device's cost and may affect its design.

SUMMARY OF THE INVENTION

One of the aims if the present invention is to provide a method for controlling a heating system of an aerosol generation assembly which is able to carry out an accurate temperature control of the vaporizable material without increasing the cost or affecting the design of the aerosol generation device.

For this purpose, the invention relates to a method for controlling a heating system for an aerosol generation assembly, the aerosol generation assembly comprising a storage portion for storing a vaporizable material, the heating system comprising a susceptor arranged in the storage portion and a heating temperature sensor arranged adjacent to the storage portion or inside the storage portion, and configured to measure the temperature of the vaporizable material.

The method comprises:

- a pre-heating phase comprising controlling the temperature of the susceptor based on at least one vaporizable material characteristic inherent to the vaporizable material or on at least one device characteristic inherent to the aerosol generation assembly or on an ambient characteristic inherent to the ambient area;
- a heating phase comprising controlling the temperature of the susceptor based on temperature measurements provided by the heating temperature sensor and a predetermined offset of said temperature measurements.

As the susceptor is arranged inside the storage portion, its temperature control is very challenging as it cannot be accessed from the outside. Hence, in most of the cases, a temperature sensor can be arranged adjacent to the storage portion and configured to measure the temperature of the vaporizable material and not the temperature of the susceptor. However, it was observed that when the vaporizable material is heated enough, its temperature differs from the susceptor temperature by an offset which can be determined empirically. Thus, it is possible to carry out a heating phase wherein the susceptor temperature is controlled very accurately basing on temperature measurements provided by the temperature sensor and the offset. It was also observed that during a pre-heating phase, the susceptor temperature can be very different from the vaporizable material temperature and can follow a different behaviour. For this purpose, the method according to the invention proposes a pre-heating phase wherein the susceptor temperature control is performed independently from the vaporizable material temperature. In this case, it is possible to control the susceptor temperature basing on at least one another parameter as a vaporizable material characteristic inherent to the vaporizable material or a device characteristic inherent to the aerosol generation assembly or an ambient characteristic inherent to the ambient area. Thus, both pre-heating phase and heating phase can be performed by modelling the susceptor temperature which can be used for a very accurate control of the vaporizable material temperature.

According to some embodiments, the or each vaporizable material characteristic corresponds to an element chosen in the group comprising:

- vaporizable material composition;
- consistency in the vaporizable material manufacturing;
- dimensions of at least one vaporizable material component;
- concentration of at least one vaporizable material component.

Thanks to these features, the susceptor temperature during the pre-heating phase can be determined according to the nature of the vaporizable material comprised in the storage portion. Particularly, it is possible to define one or several relationships between the susceptor temperature and the above-mentioned characteristics of the vaporizable material. These relationships can be determined empirically and programmed for example in the aerosol generation assembly according to the nature of the vaporizable material. Additionally, in case of changing of the vaporizable material, said relationships can be easily adapted.

According to some embodiments, the or each device characteristic corresponds to an element chosen in the group comprising:

- storage portion design;
- susceptor design;
- susceptor material;
- susceptor arrangement in the storage portion;
- ageing of at least one electrical component of the aerosol generation assembly.

Thanks to these features, the susceptor temperature during the pre-heating phase can be determined according to at least one of the above-mentioned characteristics of the device.

According to some embodiments, the ambient characteristic corresponds to the ambient temperature measured by the aerosol generation assembly or the temperature of the close surrounding of the aerosol generation assembly.

Thanks to these features, the ambient characteristic can be dynamically determined during the pre-heating phase using for example a temperature sensor arranged on a housing of the aerosol generation assembly.

According to some embodiments, the pre-heating phase comprises controlling the temperature of the susceptor based on at least one vaporizable material characteristic and on at least one device characteristic.

Thanks to these features, the control of the susceptor temperature may be more accurate. This control can for example be performed using a predetermined relationship using said vaporizable material characteristic and said device characteristic. This relationship can for example include weighting parameters relative to said characteristics which can be determined empirically.

According to some embodiments, the temperature of the susceptor further controlled based on the ambient characteristic during the pre-heating phase.

Thanks to these features, the control of the susceptor temperature can be still more accurate. For example, a predetermined relationship depending on each of said type of characteristic can be used. As for the vaporizable material characteristic and the device characteristic, the ambient characteristic can be included in said relationship with a weighting parameter empirically determined.

According to some embodiments, the pre-heating phase is performed during a predetermined time interval after activation the aerosol generation assembly.

According to some embodiments, said predetermined time interval is less than about 10 seconds, preferably less than about 5 seconds, more preferably comprised between 2 and 4 seconds, and advantageously substantially equal to 2 seconds.

Thanks to these features, it is possible to determine the instant when the heating phase is to be launched.

According to some embodiments, the predetermined offset presents a constant value over time.

Thanks to these features, the same value of the predetermined offset can be used during all of the heating phase.

According to some embodiments, the temperature of the susceptor is controlled according to a predetermined preheating temperature profile during the pre-heating phase and according to a predetermined heating temperature profile during the heating phase.

According to some embodiments, the temperature of the susceptor is controlled according to the corresponding temperature profile by controlling heat generation on the susceptor.

Thanks to these features, it is possible to control the temperature of the vaporizable material in an optimal way in order to ensure an optimal user experience. Additionally, said profiles can be determined by the user according to his/her own preferences.

According to some embodiments, a controlling phase comprises controlling the vaporizable material by comparing temperature measurements provided by the heating temperature sensor with a predetermined behaviour profile.

According to some embodiments, the controlling phase further comprises stopping the operation of the aerosol generation assembly if said temperature measurements do not match the predetermined behaviour profile.

Thanks to these features, it is possible to control the nature of the vaporizable material used by the user. For example, in case of a non-authorized or counterfeited vaporizable material, its behaviour profile can be different from a predetermined profile memorized by the assembly or accessible remotely, for example on a server. In this case, the operation of the aerosol generation device can be blocked. The above-mentioned features can be advantageously used when the vaporizable material is stored in a removable cartridge. In this case, it is for example possible to prevent using the same cartridge after it has been used a predetermined number of times or to prevent using a counterfeited or modified cartridge.

The invention also relates to an aerosol generation assembly comprising a storage portion for storing a vaporizable material and a heating system controlled by a method as defined above.

BRIEF DESCRIPTION OF THE DRAWINGS

The invention and its advantages will be better understood upon reading the following description, which is given solely by way of non-limiting example and which is made with reference to the appended drawings, in which.

DETAILED DESCRIPTION OF THE INVENTION

Figure 1:
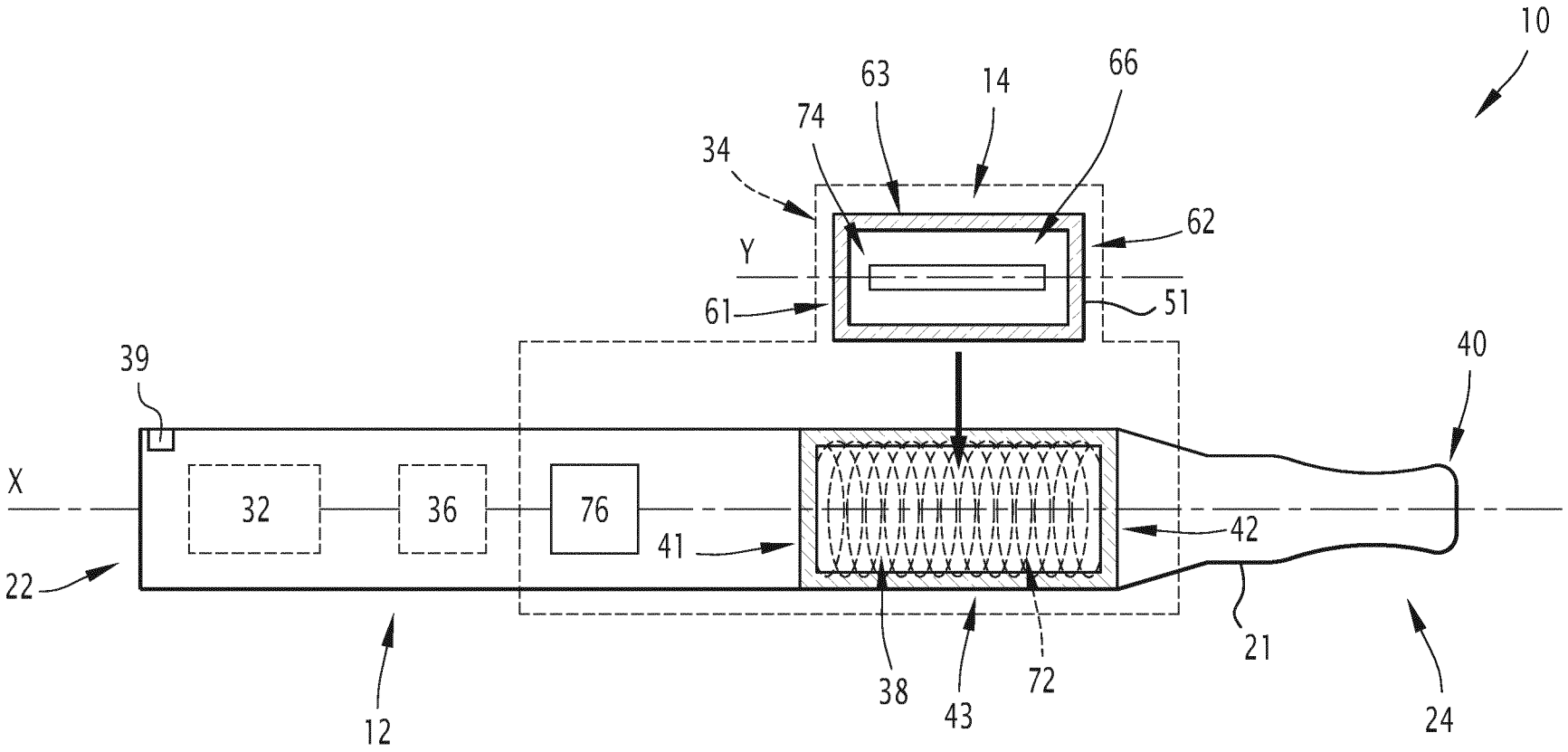
FIG. 1 is a schematic diagram showing an aerosol generation assembly according to the invention, the aerosol generation assembly comprising a heating system.

Before describing the invention, it is to be understood that it is not limited to the details of construction set forth in the following description. It will be apparent to those skilled in the art having the benefit of the present disclosure that the invention is capable of other embodiments and of being practiced or being carried out in various ways.

As used herein, the term "aerosol generation device" or "device" may include a vaping device to deliver an aerosol to a user, including an aerosol for vaping, by means of aerosol generating unit (e.g. an aerosol generating element which generates vapor which condenses into an aerosol before delivery to an outlet of the device at, for example, a mouthpiece, for inhalation by a user). The device may be portable. "Portable" may refer to the device being for use when held by a user. The device may be adapted to generate a variable amount of aerosol, e.g. by activating a heater system for a variable amount of time (as opposed to a metered dose of aerosol), which can be controlled by a trigger. The trigger may be user activated, such as a vaping button and/or inhalation sensor. The inhalation sensor may be sensitive to the strength of inhalation as well as the duration of inhalation to enable a variable amount of vapour to be provided (so as to mimic the effect of smoking a conventional combustible smoking article such as a cigarette, cigar or pipe, etc.). The device may include a temperature regulation control to drive the temperature of the heater and/or the heated aerosol generating substance (aerosol pre-cursor) to a specified target temperature and thereafter to maintain the temperature at the target temperature that enables efficient generation of aerosol.

As used herein, the term "aerosol" may include a suspension of vaporizable material as one or more of: solid particles; liquid droplets; gas. Said suspension may be in a gas including air. Aerosol herein may generally refer to/include a vapour. Aerosol may include one or more components of the vaporizable material.

As used herein, the term "vaporizable material" or "precursor" or "aerosol forming substance" or "substance" is used to designate any material that is vaporizable in air to form aerosol. Vaporization is generally obtained by a temperature increase up to the boiling point of the vaporization material, such as at a temperature less than 400° C., preferably up to 350° C. The vaporizable material may, for example, comprise or consist of an aerosol-generating liquid, gel, wax, foam or the like, an aerosol-generating solid that may be in the form of a rod, which contains processed tobacco material, a crimped sheet or oriented strips of reconstituted tobacco (RTB), or any combination of these. The vaporizable material may comprise one or more of: nicotine, caffeine or other active components. The active component may be carried with a carrier, which may be a liquid. The carrier may include propylene glycol or glycerin. A flavouring may also be present. The flavoring may include Ethylvanillin (vanilla), menthol, Isoamyl acetate (banana oil) or similar.

Referring to FIG. 1, an aerosol generation assembly 10 according to the invention comprises an aerosol generation device 12 and a cartridge 14 configured to store a vaporizable material. In the example of this FIG. 1, the cartridge 14 is removable cartridge which can be inserted in a payload compartment of the aerosol generation device 12 as it will be explained in detail below. In this case, the cartridge 14 can be for example replaced or refilled when the vaporizable material is exhausted. According to another embodiment (non-shown), the cartridge may be formed by the payload compartment of the aerosol generation device. Thus, when the vaporizable material is exhausted, the cartridge can be refilled.

As shown on FIG. 1, the aerosol generation device 12 comprises a device housing 21 extending between a battery end 22 and a mouthpiece end 24 along a device axis X.

The device housing 21 delimits an interior part of the aerosol generation device 12 comprising a power block 32 designed to power the device 12, at least a part of a heating system 34 powered by the power block 32, and a controller 36. The device housing 21 also defines a payload compartment 38 which may be arranged in the interior part of the device 12 or/and defined at least partially by at least one wall of the device housing 21. Additionally, in the example of FIG. 1, on the mouthpiece end 24, the device housing 21 defines a mouthpiece 40. The mouthpiece 40 is in a fluid communication with the payload compartment 38 and defines an airflow outlet configured to deliver aerosol to the user when the aerosol generation device 12 is operated with the cartridge 14. According to another embodiment, the mouthpiece 40 can be integrated into the cartridge 14. The device housing 21 may further comprise other internal components performing different functionalities of the device 12 known in the art.

In some embodiments, the device housing 21 further comprises an ambient temperature sensor 39 configured to measure the ambient temperature in its vicinity, for example the temperature inside the device housing 21 or the temperature on an external surface of the device housing 21 or the temperature of the close surrounding of the aerosol generation assembly 10. In the example of FIG. 1, the ambient temperature sensor 39 is arranged in the battery end 22 of the device housing 21. In some other embodiments, the device housing 21 comprises several ambient temperature sensors arranged in different places of the housing 21.

It should be noted that FIG. 1 presents only a schematic diagram of different components of the aerosol generation device 12 and does not necessarily show the real physical arrangement and dimensions of these components. Particularly, such an arrangement can be chosen according to the design of the aerosol generation device 12 and technical features of its components.

The power block 32 comprises a battery 32B (shown on FIG. 2) and a battery charger. The battery 32B is for example a known battery designed to be charged using the power supply furnished by an external source and to provide a direct current DC of a predetermined voltage. The battery 32B defines a first battery terminal which is for example a positive voltage terminal $V^+$, and a second battery terminal which if for example a negative voltage terminal $V^-$. The battery charger is able to connect the battery to the external source and comprises for this purpose a power connector (like for example a mini-USB connector) or wireless charging connector. The battery charger is also able to control the power delivered from the external source to the battery according for example a predetermined charging profile. Such a charging profile can for example define a charging voltage of the battery depending on its level of charge.

The controller 36 is able to control the operation of the aerosol generation device 12. Particularly, the controller 36 is configured to power the heating system 34 from the power block 32 to generate vapour from the vaporizable material, according to a method for controlling the heating system which will be explained in further detail below. The controller 36 can be actuated by the user via a vaping button or further to a trigger event as for example detection of a user puff. The controller 36 may perform any other additional functionality of the device 12 known per se. Such a functionality may for example concern a communication capacity of the device 12 with an external device, a maintenance capacity, an analysis capacity, etc.

The payload compartment 38 defines a cavity designed to receive the cartridge 14. In the preferred embodiment of the invention, the cavity has a cylindrical shape. In the example of FIG. 1, the payload compartment 38 extends along the device axis X between a pair of parallel walls 41, 42 of the device housing 21. In the same example, the payload compartment 38 is further delimited by at least one side wall 43 extending between the parallel walls 41, 42 along the device axis X. In this case, the payload compartment 38 may further define an opening used to insert the cartridge 14 into the payload compartment 38. The opening may for example extend perpendicularly to the device axis X and is formed when a removable part of the device housing 21 is moved away from a fixed part of the device housing 21 including notably the payload compartment 38. The removable part can for example comprise the mouthpiece 24 and the wall 42. The removable part can be hinged or screwed to the fixed part. In the embodiment where the mouthpiece 40 is integrated into the cartridge 14, the opening to the payload compartment 38 can for example extend perpendicularly to the device axis X at the mouthpiece end 24 of the device 10. In this case, the cartridge 14 can be inserted into the payload compartment 38 following the device axis X. In the embodiment where the cartridge 14 is formed by the payload compartment 38, the opening of the payload compartment 38 can be used for refilling it with the vaporizable material.

Each of the parallel walls 41, 42 is for example perpendicular to the device axis X. The wall 41 is adjacent to the battery end 22 and defines a hole suitable for an airflow passage between an airflow channel formed inside the device housing 21 and the cartridge 14. The wall 42 is adjacent to the mouthpiece end 24 and defines a hole suitable for an airflow passage between the cartridge 14 and the airflow outlet of the mouthpiece 40.

As shown on FIG. 1, the cartridge 14 comprises a cartridge housing 51 and the part of the heating system 34 which is not comprised in the aerosol generation device 12, as it will be explained below in further detail. The cartridge housing 51 extends along a cartridge axis Y between a device end and a mouthpiece end, and defines at these ends two parallel walls 61, 62 perpendicular to the cartridge axis Y and at least one lateral wall 63 extending along the cartridge axis Y between the parallel walls 61, 62. In the preferred embodiment of the invention, the cartridge housing 51 has a cylindrical shape. In this case, the parallel walls 61, 62 can have a circular shape. The walls 61, 62, 63 of the cartridge housing 51 are made of a dielectric material like for example a plastic material. Advantageously, according to the invention, the walls 61, 62, 63 can form a single piece made by an appropriate industrial process. The walls 61, 62, 63 of the cartridge housing 51 delimit a storage portion 66 configured to store the aerosol forming precursor.

In the example of FIG. 1, when the cartridge 14 is received into the payload compartment 38 of the aerosol generation device 12, the cartridge axis Y coincides with the device axis X and the parallel walls 61, 62 of the cartridge housing 51 are in contact with the parallel walls 41, 42 of the payload compartment 38. Particularly, in this case, the wall 61 is in contact with the wall 41 and defines an airflow inlet facing the corresponding hole of the wall 41 to allow entering the airflow into in the cartridge 14. Similarly, the wall 62 is in contact with the wall 42 and defines an airflow outlet facing the corresponding hole of the wall 42 to allow evacuating the airflow from the cartridge 14.

Figure 2:
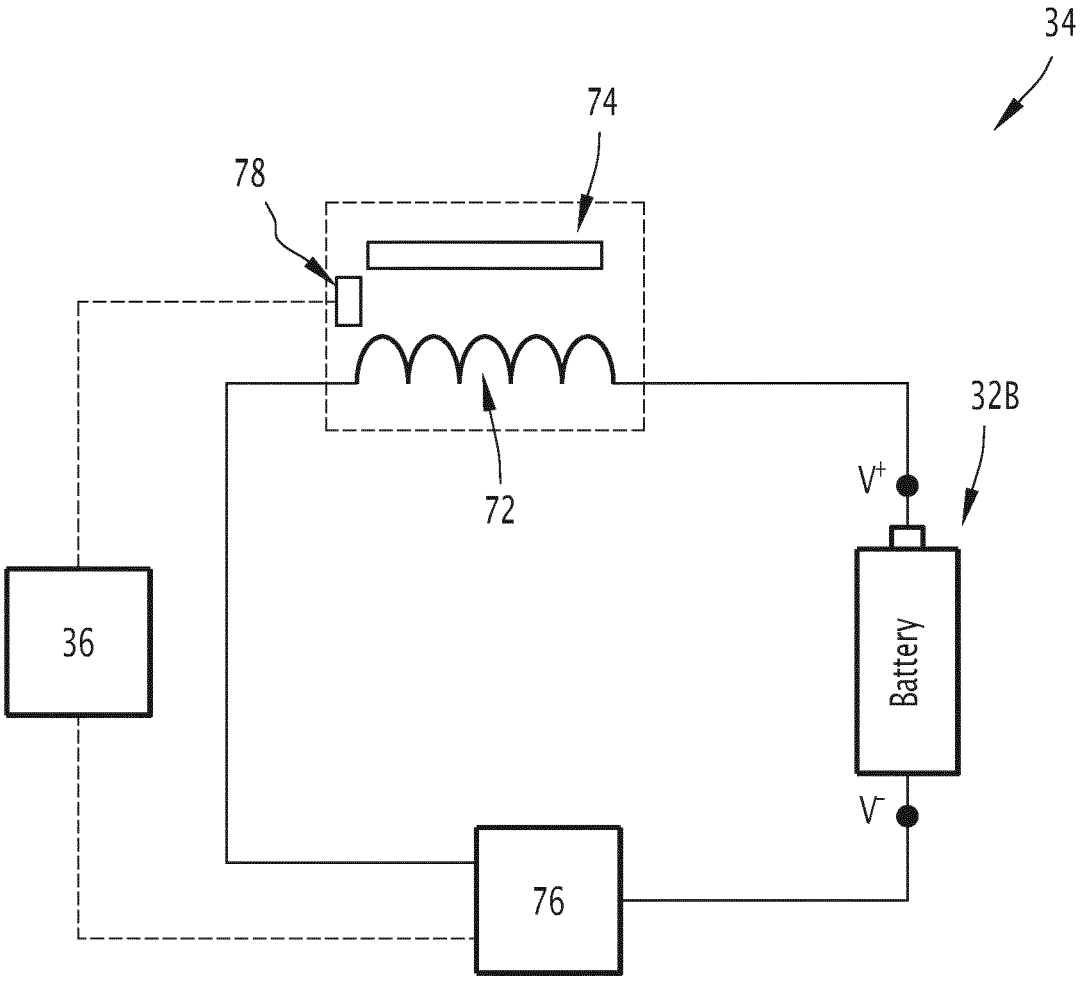
FIG. 2 is a schematic diagram showing the heating system of FIG. 1.

FIG. 2 shows in more detail the heating system 34. Referring to this FIG. 2, the heating system 34 comprises a coil 72 arranged in vicinity of the storage portion 66, when the cartridge 14 is received in the payload compartment 38, a susceptor 74 arranged in the storage portion 66, an oscillation circuitry 76 configured to generate AC current on the coil 72 from the DC current provided by the battery 32B and a heating temperature sensor 78 configured to measure the temperature of the vaporizable material.

The coil 72 and the susceptor 74 are arranged respectfully so as to the susceptor 74 is able to heat the vaporizable material further to magnetic interaction with the coil 72. A particular example of such an arrangement is shown on FIG. 3.

Figure 3:
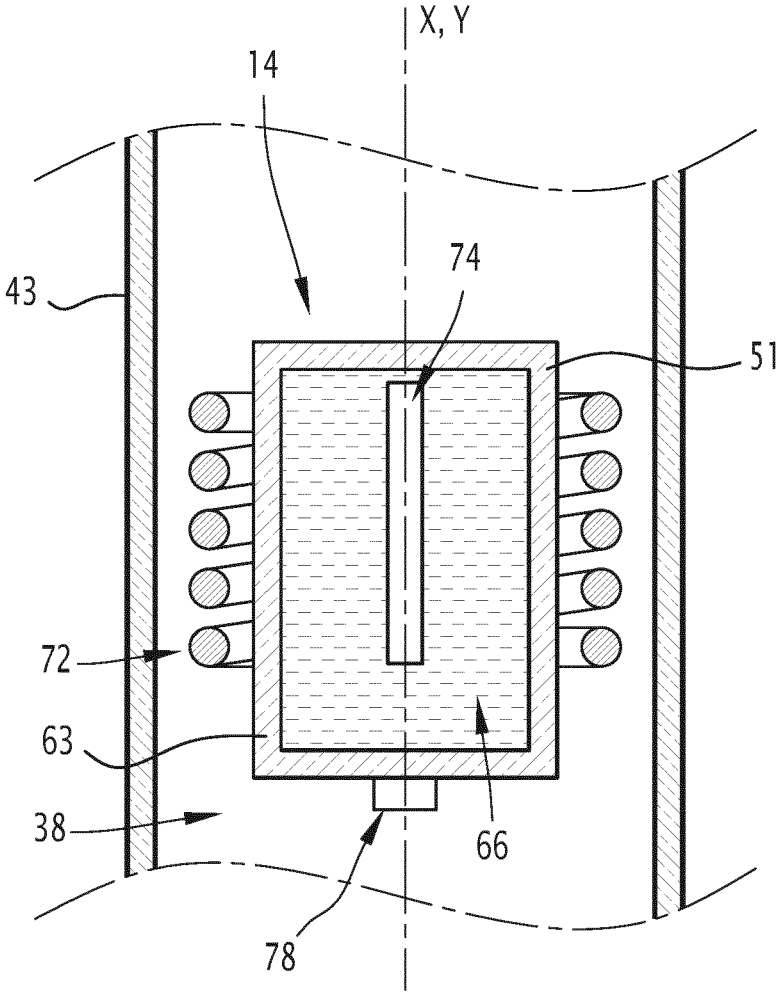
FIG. 3 is a detailed view of an exemplary arrangement of the heating system of FIG. 1.

Referring to this FIG. 3, the coil 72, also visible on FIG. 1 on dashed line, is intended to be arranged around the storage portion 66 of the cartridge 14 along the cartridge axis Y when the cartridge 14 is received in the payload compartment 38. Particularly, in the example of FIGS. 1 and 3, the coil 72 is intended to extend around the lateral wall 63 of the cartridge housing 51, and preferably, significantly along the whole length of the lateral wall 63. For this purpose, the coil 72 is integrated into the side wall 43 of the payload compartment 38 or protrudes from this side wall 43 to extend around the payload compartment 38 along the device axis X. Thus, the coil 72 is integrated into the device 12 and when the cartridge 14 is received in the payload compartment 38, the coil 72 extends around the lateral wall 63 of the cartridge housing 51 and consequently, around the storage portion 66 of the cartridge 14.

The susceptor 74 is arranged in the storage portion 66 of the cartridge 14, preferably along the cartridge axis Y. The susceptor 74 is made of a conductive material, for example a metallic material such as aluminium or aluminium alloys, or ferromagnetic material such as mild-steel. The shape and the dimensions of the susceptor 74 are chosen so as to optimize the magnetic coupling and consequently the energy transfer efficiency with the coil 72. The shape and the dimensions of the susceptor 74 are also chosen depending on the cartridge's format. According to the example of FIG. 3, the susceptor 74 has a parallelepiped shape extending along the cartridge axis Y. According to another example, the susceptor 74 has a thin tube shape also extending along the cartridge axis Y. For example, the tube can define a wall thickness comprised between 30 μm and 150 μm, and for example substantially equal to 50 μm. A greater wall thickness can be chosen to simplify the manufacturing process. According to both examples, the length of susceptor 74 can be chosen between 5 mm and 13 mm, advantageously between 7 mm and 11 mm. In general case, the shape of the susceptor 74 is chosen so as to concentrate better the electromagnetic field created by the coil 72. For example, for the coil 72 having a round shape where the strength of the field is the lowest in the geometric centre, the shape of the susceptor 74 is chosen so as to be closer to the windings of the coil 72. According to some embodiments, the susceptor 74 can be made from several separate elements having substantially the same shape and dimensions or different shapes and/or dimensions.

The heating temperature sensor 78 is arranged so as to be able to measure the temperature of the vaporizable material. For example, as it is shown on FIG. 3, the heating temperature sensor 78 can be adjacent to at least one wall of the cartridge housing 51, for example to one of the parallel walls 61, 62. According to another example, the heating temperature sensor 78 can form at least partially such a wall. According to still another embodiment, the heating temperature sensor 78 is arranged inside the storage portion 66. According to the preferred embodiment of the invention, the heating temperature sensor 78 is arranged to be in contact with the vaporizable material. The heating temperature sensor 78 can correspond to any known sensor, as for example "PT100" sensor.

The method for controlling the heating system 34, also called control method, will now be explained, notably in reference to FIG. 4. As mentioned above, this method is for example carried out by the controller 36. According to the invention, the control method comprises a pre-heating phase intended to pre-heat the vaporizable material and a heating phase intended to heat the vaporizable material to generate aerosol.

The pre-heating phase is activated by the controller 36 further for example to detecting activation of the vaping button by the user or a trigger event as for example detection of a user puff. During this phase, the controller 36 powers the heating system 34 to cause a predetermined pre-heating temperature profile on the susceptor 74. This predetermined pre-heating temperature profile is for example determined empirically to ensure an optimal user experience. According to another embodiment, the predetermined pre-heating temperature profile is chosen by the user according to his/her own preferences.

For causing the predetermined pre-heating profile on the susceptor 74, the controller 36 is able to control the operation of the heating system 34, through controlling the operation of the oscillation circuitry 76 which powers the coil 72. The coil 72 induces currents on the susceptor 74 which are transformed in heat. During the pre-heating phase, the control of the heating system 34 carried out by the controller 36 is based on at least one vaporizable material characteristic inherent to the vaporizable material or on at least one device characteristic inherent to the aerosol generation assembly 10 or on an ambient characteristic inherent to the ambient area. Thus, during the pre-heating phase, the heating system 34 is controlled using at least one external characteristic, which means that it is controlled according to an open-loop control. In some embodiments, the controller 36 is able to control the operation of the heating system 34 using at least two different types of said characteristics. In some embodiments, the operation of the heating system 34 is performed using all of the types of said characteristics. For the example, the controller 36 may control the operation of the heating system 34 basing on at least one vaporizable material characteristic and on at least one device characteristic. Additionally, this control can be performed basing further on the ambient characteristic.

Particularly, in some cases, the controller 36 can control the powering of the heating system 34 basing on at least one of said characteristics. For this purpose, the controller 36 can use for example a predetermined relationship between at least one of said characteristics and power delivered to the heating system 34 from the battery 32B. Such a relationship can be written in the following form:

$$P=F(c),$$

where P is the power delivered to the heating system 34 and c is at least one of said characteristics. As mentioned before, the function F can depend on several characteristics of different types. Moreover, it can also depend on several values of the same characteristic changing for example with the time. The function F can further depend on time. For example, during the first second of the pre-heating phase, 100% of available power can be provided to the heating system 34. During the following second, the power can be reduced to 80% and during the following second to 50%. In a variant, said predetermined relationship between at least one of said characteristics and power delivered to the heating system 34 can be expressed in a form of a look up table basing for example on empirical data.

According to the invention, each vaporizable material characteristic corresponds to an element chosen in the group comprising:

- vaporizable material composition;
- consistency in the vaporizable material manufacturing;
- dimensions of at least one vaporizable material component;
- concentration of at least one vaporizable material component.

Thus, each vaporizable material characteristic can be determined depending on the nature of the vaporizable material contained in the cartridge 14. This characteristic can be provided for example by the manufacturer and memorized by the controller 36. Thus, upon detection a new cartridge 14, the controller 36 determines for example the nature of the vaporizable material and depending on this nature, at least one vaporizable material characteristic. For this purpose, the cartridge 14 can comprise a memory, like an NFC tag, able to transmit to the controller 36 data relative to the nature of the vaporizable material. Alternatively, the nature of the vaporizable material can be provided by the user using for example an appropriate user interface integrated into the aerosol generation assembly 10 or an external device communicating with the controller 36. According to still another embodiment, upon detection a new cartridge 14, the controller 36 determines directly at least one vaporizable material characteristic from data provided by the cartridge 14. Alternatively, this characteristic can be provided by the user.

According to the invention, each device characteristic corresponds to an element chosen in the group comprising:

- storage portion design, as for example the shape and the dimensions of the storage portion 66;
- susceptor design, as for example the shape, the form (unique piece or not) and the dimensions of the susceptor;
- susceptor material;
- susceptor arrangement in the storage portion;
- ageing of at least one electrical component of the aerosol generation assembly.

The last element can concern for example the ageing of the susceptor 74, the coil 72 and/or the battery 32B and can be stored and changed over time by the controller 36.

The ambient characteristic can correspond to the ambient temperature or the temperature of the close surrounding of the aerosol generation assembly 10, measured by ambient temperature sensor 39. In a variant, the ambient characteristic can correspond to an average temperature of several temperature values determined by different temperature sensors arranged in different places of the aerosol generation assembly 10.

In one embodiment of the invention, the duration of the pre-heating phase is fixed to a predetermined time interval.

This duration can be for example less than about 10 seconds, preferably less than about 5 seconds, more preferably comprised between 2 and 4 seconds, and advantageously substantially equal to 2 seconds or to 3 seconds. In this case, the controller 36 detects the end of said predetermined time interval and launches the heating phase. According to another embodiment of the invention, the duration of the pre-heating phase is determined dynamically by the controller 36 basing for example on at least one of the characteristics mentioned above. For example, the duration of the pre-heating phase may be determined as a function of the ambient temperature. In this case, the controller 36 determines first the duration of the pre-heating phase and then, finishes the pre-heating phase and launches the heating phase according to this duration. Advantageously, in both cases, it is considered that at the end of the pre-heating phase, the vaporizable material is heated until a steady temperature, for example until the temperature causing aerosol generation.

As during the pre-heating phase, during the heating phase, the controller 36 powers the heating system 34 to cause a predetermined heating temperature profile on the susceptor 74. This predetermined heating temperature profile is for example determined empirically to ensure an optimal user experience. According to another embodiment, the predetermined heating temperature profile is chosen by the user according to his/her own preferences. The predetermined heating temperature profile may for example be chosen to maintain the same temperature of the susceptor 74 during all vaping session.

For causing the predetermined heating temperature profile on the susceptor 74, as during the pre-heating phase, the controller 36 is able to control the operation of the heating system 34, through controlling the operation of the oscillation circuitry 76 and notably the powering of the coil 72. However, during the heating phase, the controller 36 controls the operation of the heating system 34 basing on temperature measurements provided by the heating temperature sensor 78 and a predetermined offset. Since no external characteristic except the temperature measurements is used, this type of control is called closed-loop control. In some embodiments, the temperature measurements can be issued from several heating temperature sensors arranged in vicinity of the storage portion 66 and/or inside the storage portion 66.

The predetermined offset corresponds to the difference between the temperature of the susceptor 74 and the temperature measured by the heating temperature sensor 78, i.e. temperature measurements of the vaporizable material. The offset can present a constant value over time. According to another embodiment, the offset can vary over time, according for example to predetermined law. In both cases, the offset can be determined empirically. In some embodiments, the offset can be a function of at least one characteristic explained above. Particularly, the offset can be determined as a function of at least one vaporizable material characteristic inherent to the vaporizable material and/or at least one device characteristic inherent to the aerosol generation assembly 10 and/or the ambient characteristic inherent to the ambient area. For example, the offset can be determined in function of the storage portion and/or susceptor design. Particularly, in some embodiments, the offset can be proportional to the distance between the susceptor 74 and the temperature sensor 78.

As in the previous case, to control the susceptor temperature, the controller 36 can control the powering of the heating system 34 using for example a predetermined relationship between the temperature measurements and the offset on one side, and power delivered to the heating system 34 from the battery 32B, on the other side. Such a relationship can be written in the following form:

$$P=f(T_k,O),$$

where P is the power delivered to the heating system 34, $T_k$ is a temperature measurement at k-instant and O is the predetermined offset, which can depend on one or several characteristics, as mentioned before.

Figure 4:
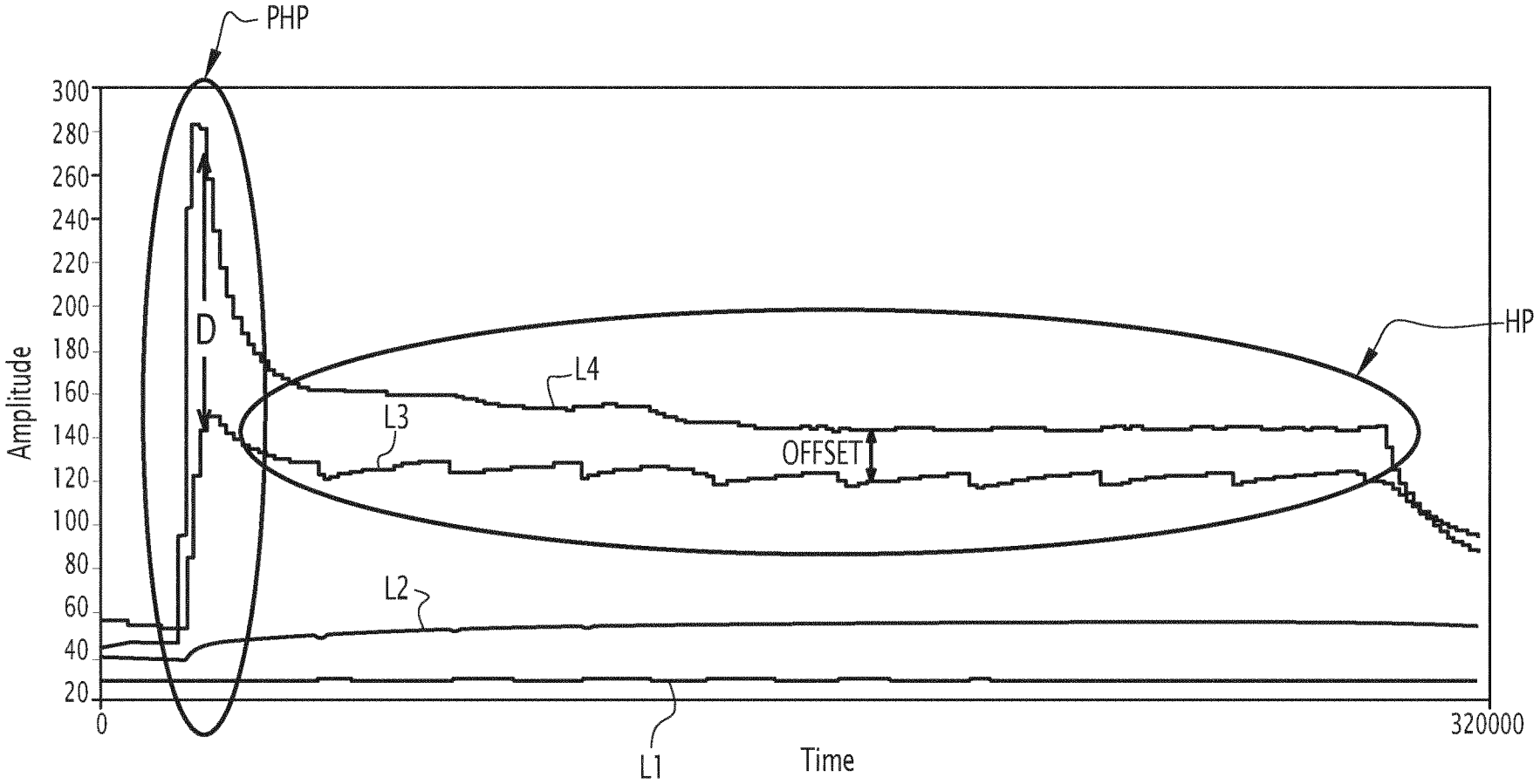
FIG. 4 is a schematic diagram illustrating a method for controlling the heating system of FIG. 2.

FIG. 4 shows different temperature measurements while performing the pre-heating phase PHP and the heating phase HP of the control method according to the invention. On this FIG. 4, curve L1 corresponds to temperature measurements of the ambient area far from the aerosol generation assembly 10, curve L2 corresponds to temperature measurements performed on the surface of the aerosol generation assembly 10 using for example the ambient temperature sensor 39, curve L3 corresponds to temperature measurements of the vaporizable material performed for example by the heating temperature sensor 78 and curve L4 corresponds to temperature measurements of the susceptor 74. It can be seen that curve L1 remains substantially constant over all vaping session and curve L2 shows a slight temperature increasing after the pre-heating phase. As for curves L3 and L4, it can be seen that their behaviours are very different during the pre-heating phase PHP. Particularly, the susceptor temperature increases significantly during the pre-heating phase PHP in comparison with the vaporizable material temperature. Their maximal difference D can be several times greater than the offset during the heating phase HP. However, as explained above, the susceptor temperature can be modelled using one or several characteristics mentioned above. On the contrary, during the heating phase HP, the difference between the susceptor temperature and the vaporizable material temperature is more regular and can be modelled by the offset.

According to a particular embodiment of the invention, the control method further comprises a controlling phase carried out for example during the pre-heating phase. Particularly, during this controlling phase, the controller 36 acquires temperature measurements of the vaporizable material, provided for example by the heating temperature sensor 78, and compare these measurements with a predetermined behaviour profile of the vaporizable material. The behaviour profile can for example be stored by the controller 36 and/or be accessible remotely, for example on a server. Such a behaviour profile can correspond to a normal behaviour of the temperate increasing of a known vaporizable material during the pre-heating phase. If the measurements do not match the predetermined behaviour profile, the controller 56 can stop the operation of the heating system 34 and/or emit a corresponding signal to the user. In this case, it is considered that the vaporizable material used by the user does not correspond to the vaporizable material intended to be used with the aerosol generation assembly 10. This can for example occur in case when the vaporizable material (or cartridge 14) is counterfeited or when the user intends to use the vaporizable material (or cartridge 14) for the second time. In this case, the controller 36 can resume the normal operation of the heating system 34 when for example the user replaces the cartridge 14 by a new one containing a known vaporizable material or a vaporizable material authorized to be used by the user.

The invention claimed is:

1. A method for controlling a heating system for an aerosol generation assembly, the aerosol generation assembly comprising a storage portion for storing a vaporizable material, the heating system comprising a susceptor arranged in the storage portion and a heating temperature sensor arranged adjacent to the storage portion or inside the storage portion, and configured to measure a temperature of the vaporizable material;

the method comprising:

controlling a temperature of the susceptor, during a pre heating phase, based on at least one vaporizable material characteristic inherent to the vaporizable material, or based on at least one device characteristic inherent to the aerosol generation assembly, or based on an ambient characteristic inherent to the ambient area;

controlling the temperature of the susceptor, during a heating phase, based on temperature measurements provided by the heating temperature sensor and a predetermined offset, the predetermined offset comprising an empirically determined difference between a current temperature of the susceptor and the temperature of the vaporizable material during the heating phase.

2. The method according to claim 1, wherein the controlling of the temperature of the susceptor during the pre-heating phase is based on the at least one vaporizable material characteristic, and wherein the at least one vaporizable material characteristic corresponds to an element chosen in the group consisting of:

vaporizable material composition;

consistency in the vaporizable material manufacturing;

dimensions of at least one vaporizable material component; or concentration of at least one vaporizable material component.

3. The method according to claim 1, wherein the controlling of the temperature of the susceptor during the pre-heating phase is based on the at least one device characteristic, and wherein the at least one device characteristic corresponds to an element chosen in the group consisting of:

storage portion design;

susceptor design;

susceptor material;

susceptor arrangement in the storage portion; or ageing of at least one electrical component of the aerosol generation assembly.

4. The method according to claim 1, wherein the controlling of the temperature of the susceptor during the pre-heating phase is based on at least the ambient characteristic, and wherein the ambient characteristic corresponds to the ambient temperature measured by the aerosol generation assembly or the temperature of closely surrounding the aerosol generation assembly.

5. The method according to claim 1, wherein the pre-heating phase comprises controlling the temperature of the susceptor based on at least one vaporizable material characteristic and at least one device characteristic.

6. The method according to claim 5, wherein the temperature of the susceptor is further controlled based on the ambient characteristic during the pre-heating phase.

7. The method according to claim 1, wherein the pre-heating phase is performed during a predetermined time interval after activation of the aerosol generation assembly.

8. The method according to claim 7, wherein said predetermined time interval is less than about 10 seconds.

9. The method according to claim 8, wherein said predetermined time interval is between 2 and 5 seconds.

10. The method according to claim 9, wherein said predetermined time interval is substantially equal to 2 seconds.

11. The method according to claim 1, wherein the predetermined offset presents a constant value over time.

12. The method according to claim 1, wherein the temperature of the susceptor is controlled according to a predetermined pre-heating temperature profile during the pre-heating phase and according to a predetermined heating temperature profile during the heating phase.

13. The method according to claim 12, wherein the temperature of the susceptor is controlled according to the predetermined pre-heating temperature profile during the pre-heating phase and according to the predetermined heating temperature profile during the heating phase by controlling heat generation on the susceptor.

14. The method according to claim 1, further comprising controlling the vaporizable material, during a controlling phrase, by comparing temperature measurements provided by the heating temperature sensor with a predetermined behaviour profile.

15. The method according to claim 14, wherein the controlling phase further comprises stopping operation of the aerosol generation assembly if said temperature measurements do not match the predetermined behaviour profile.

16. The method according to claim 14, wherein the controlling phase is carried out during the pre-heating phase.

17. An aerosol generation assembly comprising a storage portion for storing a vaporizable material and a heating system controlled by a method according to claim 1.

* * * * *